United States Patent [19]

Sigonneau

[11] Patent Number: 4,580,622

[45] Date of Patent: Apr. 8, 1986

[54] WATER BOX AND EXPANSION CHAMBER DEVICE FOR A HEAT EXCHANGER, IN PARTICULAR A RADIATOR FOR A MOTOR VEHICLE

[75] Inventor: Jacques Sigonneau, Chatou, France

[73] Assignee: Valeo, Paris, France

[21] Appl. No.: 684,378

[22] Filed: Dec. 20, 1984

[30] Foreign Application Priority Data

Dec. 28, 1983 [FR] France ..... 83 20956
Sep. 24, 1984 [FR] France ..... 84 14632

[51] Int. Cl.[4] ..... F28D 13/00
[52] U.S. Cl. ..... 165/104.32; 123/41.54
[58] Field of Search ..... 165/104.32; 123/41.51, 123/41.54

[56] References Cited

U.S. PATENT DOCUMENTS 3,077,927 2/1963 White et al. ..... 123/41.54
4,116,268 9/1978 Kruger ..... 123/41.54
4,457,362 7/1984 Cadars ..... 165/104.32

FOREIGN PATENT DOCUMENTS 3021918 12/1980 Fed. Rep. of Germany ..... 165/104.32
2483798 12/1981 France .
2499704 8/1982 France .
2506001 11/1982 France .
2511489 2/1983 France .
2514479 4/1983 France .

*Primary Examiner*—Albert W. Davis, Jr.
*Attorney, Agent, or Firm*—Dennison, Meserole, Pollack & Scheiner

[57] ABSTRACT

The invention relates to a device comprising a water box (18) and an expansion chamber (20) for a heat exchanger for a flowing liquid. The device is moulded in one piece and has integrally moulded therewith a duct (30) whose upper end is closed by the cover of the expansion chamber (20) and whose lower end communicates, e.g. via a second duct (32), with the expansion chamber in order to form a liquid-degassing passage. The invention is particularly applicable to the radiator of a cooling circuit for an internal combustion engine in a motor vehicle.

13 Claims, 7 Drawing Figures

WATER BOX AND EXPANSION CHAMBER DEVICE FOR A HEAT EXCHANGER, IN PARTICULAR A RADIATOR FOR A MOTOR VEHICLE

The invention relates to a water box and expansion chamber device for a heat exchanger such as the radiator in the cooling circuit of an internal combustion engine for a motor vehicle.

BACKGROUND OF THE INVENTION

Water box and expansion chamber devices for such heat exchangers are already known in which the water box and the expansion chamber are made in a single piece of moulded plastic, the expansion chamber having an open end through which a moulding core is extracted and subsequently closed by an added-on cover which may be fitted with a fitting for filling the expansion chamber and suitable for receiving a stopper having safety valves for releasing too high or too low a pressure.

It is also known to provide a passage for degassing the liquid in such a device, said passage connecting the water box to the expansion chamber in such a manner that bubbles of air or gas transported by the liquid circulating through the water box can be injected into the expansion chamber by means of a relatively lower pressure existing in the expansion chamber. This prevents bubbles of air or gas from accumulating in various parts of the engine block which may lead to "hot points" which could damage the engine.

In the known technique, the degassing passage is often formed by an added-on tube which passes through the wall(s) separating the water box from the expansion chamber. To set up communication between the two different levels, the tube leaves from the upper part of the water box and ends beneath the free surface of the liquid contained in the expansion chamber. Placing such a tube and fixing it in place is not easy, particularly in mass production, and as a result the price of the device is increased.

Further, the water box of such a device is itself generally fitted with a tube for connection to the liquid circuit, said tube being integrally moulded with the water box.

In order to be able to fit the radiator in the limited space available in the engine compartment of a motor vehicle, this tube is sometimes required to have a particular disposition and orientation, thus posing moulding problems and, in particular, problems concerned with extracting the moulding cores which serve to define its inside surface. Proposals have already been made for solving this problem by providing a lateral core-extraction orifice in the tube. Said orifice being subsequently closed by means of a piece or plate of plastic material which may be welded in place ultrasonically, for example.

However, placing and welding the extra part also constitute additional operations in manufacture thus increasing the overall cost of the device.

SUMMARY OF THE INVENTION

Preferred embodiments of the present invention overcome these drawbacks of the prior art by providing a water box and expansion chamber device for a heat exchanger such as a radiator for the cooling circuit of an internal combusion engine, wherein the expansion chamber has an open end on which a closing cover is fixed, and wherein the device includes the improvement comprising a duct communicating with the water box and having an orifice in its portion adjacent to the open end of the expansion chamber, which orifice is closed in a sealed manner by the cover of the expansion chamber.

This duct is advantageously parallel to the axis of the expansion chamber and opens out at its lower end in a second duct integrally formed by moulding with the water box and the expansion chamber.

In a preferred embodiment of the invention, one end of the second duct opens out into the expansion chamber in such a manner that the two ducts form a liquid degassing passage.

Preferably, the other end of the second duct opens out in the water box and is closed in a sealed manner during assembly of the water box on the body of a heat exchanger.

Thus, a water box and expansion chamber device is directly obtained from a moulding which includes a liquid degassing passage which is directly usable without requiring any assembly operation other than those which are required in any case to assemble the water box on the body of the heat exchanger.

This provides a considerable saving in the cost of manufacturing such a water box and expansion chamber device, since the device may be manufactured and assembled using mass production techniques that do not require manual intervention.

In a second embodiment of the invention, the duct having the above-mentioned orifice constitutes a portion of a tube for connecting the water box to a liquid circuit, said tube being integrally moulded with the water box.

In this case, the above-mentioned orifice of the duct is used for extracting a moulding core from one portion of the tube, and is closed by the cover for the open end of the expansion chamber, thus it is closed without requiring an additional manufacturing operation.

Preferably, the tube is generally bent in form, comprising a first branch connected to the water box and in which the above-mentioned orifice opens out, and a second branch which is, for example, perpendicular to the first branch or to the plane of the open face of the water box.

It is thus possible to obtain a particular orientation of the tube relative to the water box as a function of the desiderata of motor vehicle manufacturers.

BRIEF DESCRIPTION OF THE DRAWINGS

Embodiments of the invention are described by way of example with reference to the accompanying drawings, in which.

MORE DETAILED DESCRIPTION

Figure 1:
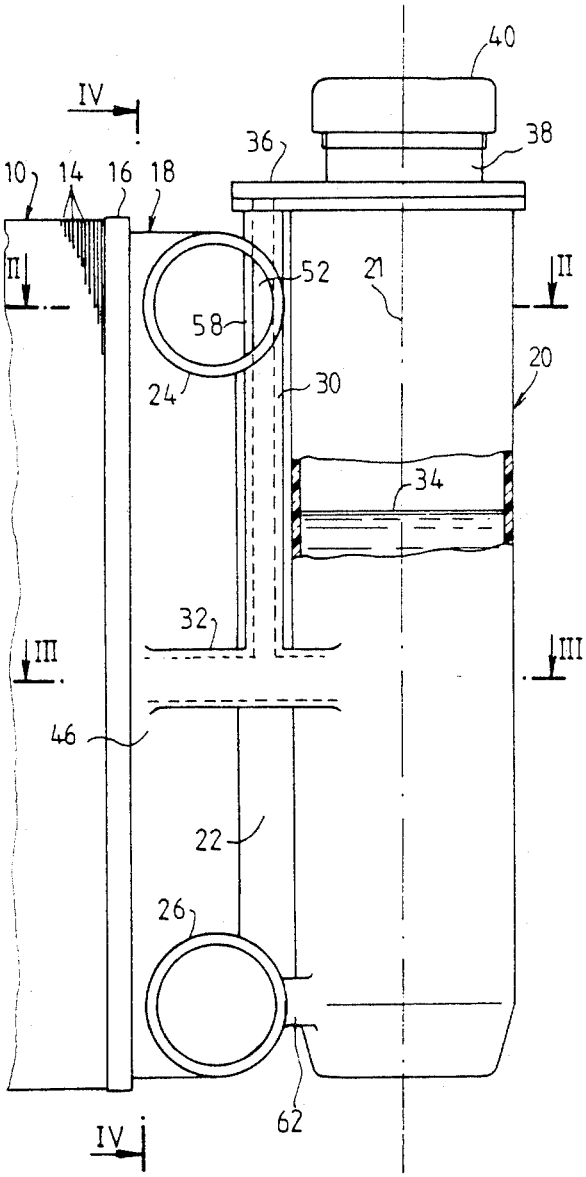
FIG. 1 is a plan view of a device in accordance with the invention and mounted on the body of a heat exchanger.
Figure 4:
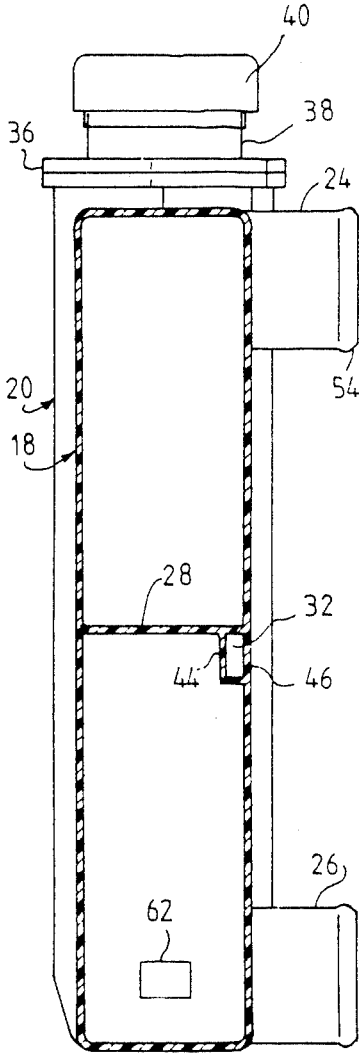
FIGS. 2, 3 and 4 are sections on respective lines II—II, III—III and IV—IV in FIG. 1.
Figure 2:
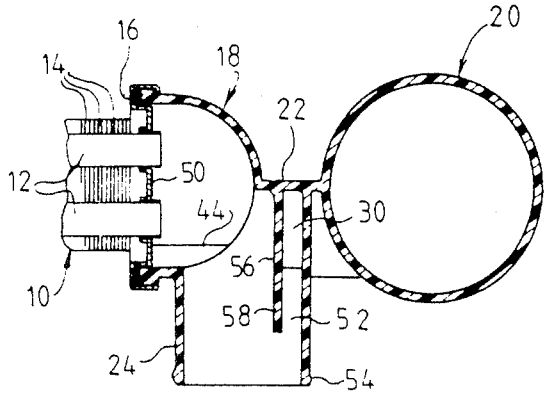
Figure 3:
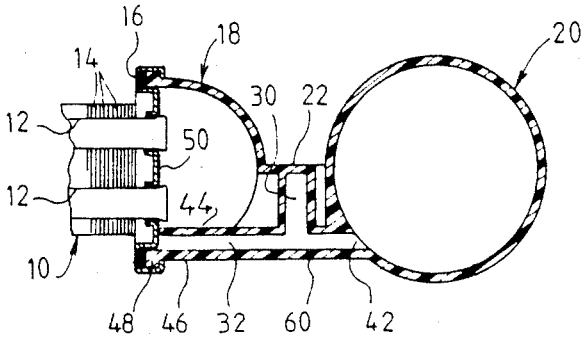

In FIGS. 1 to 4, reference 10 designates the body of a heat exchanger having a conventional structure of a bundle of tubes 12 provided with fins 14. The ends of the tubes 12 are mounted in a sealed manner in holes in a perforated plate 16 which is fixed in conventional manner to the water box of a device in accordance with the invention.

The water box 18 is conventionally of substantially semi-cylindrical shape and closed at its ends. It is obtained as part of a one-part moulding together with the expansion chamber 20 having a circular section and which is substantially cylindrical or slightly tapering in order to facilitate unmoulding and extraction of a moulding core via an open end. Its lower end is closed by an integral part of the moulding. A thin sheet 22 from the moulding links the water box 18 to the expansion chamber 20.

The water box 18 is integrally moulded with an inlet tube 24 for heating exchanger liquid. In this embodiment, the liquid flows through a U-type heat exchanger and the water box 18 is also integrally moulded with a liquid outlet tube 26 and a partition 28 separating the inside of the water box into two substantially identical compartments, one of which is in communication with the inlet tube 24 and the other of which is in communication with the outlet tube 26. Thus, the cooling liquid for an internal combustion engine entering the heat exchanger via the tube 24 passes through the first compartment of the water box 18, flows along the tubes 12 of the top half of the bundle of tubes 10, flows through a water box provided at the other end of the bundle 10, and returns to the water box 18 by flowing along the tubes in the bottom half of the bundle 10, finally leaving the water box 18 via the tube 26 to return to the internal combustion engine.

The invention provides a liquid degassing passage which enters the water box 18 via the inlet tube 24, which liquid degassing passage is integrally moulded with the water box 18 and the expansion chamber 20 and comprises a first duct 30 extending parallel to the axis 21 of the expansion chamber 20, and a second duct 32 extending substantially parallel to the unmoulding direction of the water box 18, i.e. parallel to the tubes 12 of the bundle 10.

The first duct 30 is formed on the sheet 22 interconnecting the water box 12 and the expansion chamber 20, and it extends from the top end of the expansion chamber 20 to below the level 34 of the liquid which is normally contained in the expansion chamber 20 when the heat exchanger is in use. The open top end of the duct 30, which constitutes the unmoulding end of the duct, is closed by an add-on plate 36 which also closes the top end of the expansion chamber 20 and which includes a fitting 38 which constitutes a filling orifice and which is suitable for being closed by a stopper 40 of conventional type.

The bottom end of the first duct 30 opens directly into the second duct 32 which is provided below the normal liquid level 34 in the expansion chamber 20. One end 42 of the second duct 32 opens out into the expansion chamber 20 while the opposite end opens out into the water box 18. This end of the duct 32 is formed by a partition 44 which extends from the side wall 46 of the water box 18 and proceeds with an L-shaped cross-section to meet the partition 28 which divides the water box into two compartments in the embodiment shown, or else, the partition 44 has a U-shaped cross-section and depends solely from the side wall 46 when the water box does not include a partition 28 dividing it into two compartments. The partition 44 extends towards the open face of the water box 18, i.e. substantially parallel to the tubes 12 and ends slightly before the peripheral rim 48 of the water box to which the edge of the perforated plate 16 is attached when assembling the water box to the heat exchanger bundle 10. The end of the partition 44 is thus sealed, when the water box 18 is assembled to the heat exchanger bundle 10 by means of a gasket 50 which covers the face of the perforated plate 16 that is turned towards the water box 18.

The first duct 30 of the degassing passage passes through the inlet tube 24 and communicates therewith via an opening 52 which is formed during moulding in the wall of the duct 30 situated furthest from the sheet 22 so that the opening 52 looks towards the free end 54 of the inlet pipe 24. In the embodiment shown, the side wall 56 of the duct 30 inside the tube 24 is extended at 58 towards the free end 54 of the inlet tube 24 and the other side wall of the duct 30 is substantially tangential to the cylindrical wall of the tube 24.

It may be observed that the outside wall 60 of the second duct 32 is substantially tangential to the curved wall 46 of the water box where it meets the peripheral rim 48 of the water box.

In conventional manner, the bottom end of the expansion chamber 20 is connected by an integrally moulded duct 62 to the bottom portion of the water box 18.

The device comprising the water box and the expansion chamber in accordance with the invention is used in conventional manner.

When the device is assembled to the bundle 10 of the heat exchanger, the end of the second duct 32 which is distant from the expansion chamber 20 is closed in a sealed manner by the end of the partition 44 bearing against the gasket 50 which covers the perforated plate 16. In use, the engine-cooling liquid enters the water box 18 via the inlet tube 24, flows through the heat exchanger and leaves via the outlet tube 26 to return to the internal combustion engine. Bubbles of air or gas which are conveyed by the cooling liquid are captured by the degassing passage 52, 30, 32 before they reach the water box 18 and are conveyed to the expansion chamber 20 below the level 34 of the liquid contained therein. The bubbles of gas or air then rise to the upper portion of the expansion chamber 20 where they are trapped. This ensures proper degassing of the liquid flowing through the heat exchanger.

There are no special problems associated with moulding and unmoulding a device in accordance with the invention.

Figure 5:
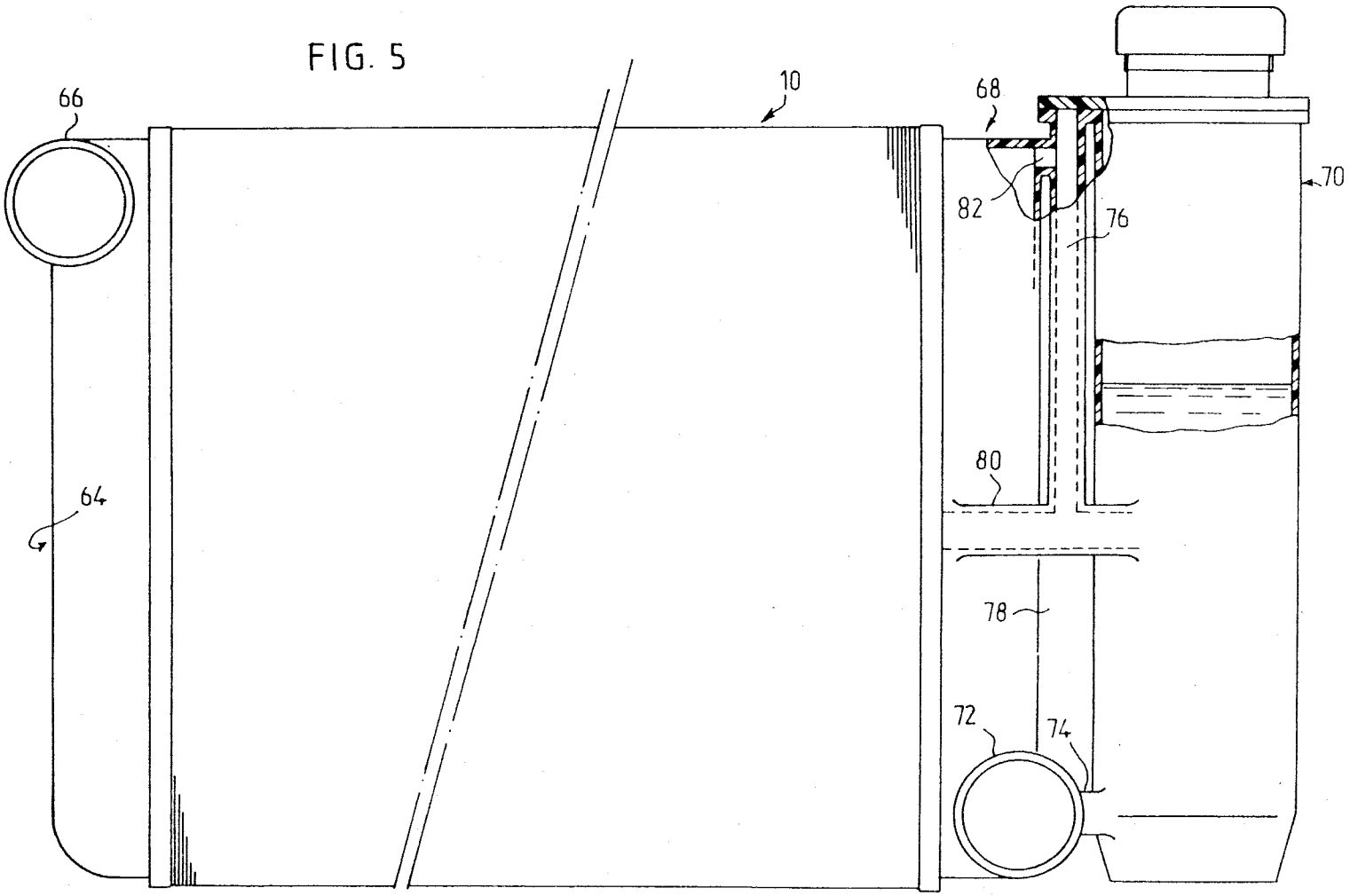
FIG. 5 is a front view of variant embodiment.

Reference is now made to FIG. 5 which shows a variant embodiment of the invention which differs from the embodiment shown in FIGS. 1 to 4 in that the inlet tube for admitting liquid to the heat exchanger is not formed on the water box of the device in accordance with the invention, but is formed on the water box located at the other end of the bundle of tubes 10.

The heat exchanger shown in FIG. 5 thus comprises a water box 64 mounted at the other end of the bundle of tubes 10 (left-hand side of the figure) and provided with a liquid inlet tube 66, while the device in accordance with the invention forms a water box 68 and an expansion chamber 70 which are mounted at the other end of the bundle 10 (right-hand side of the figure).

The bottom of the water box 68 is provided with an outlet tube 72 and is connected to the lower part of the expansion chamber 70 by an integrally moulded duct 74.

As in the preceding embodiment, a degassing passage obtained as an integral part of the moulding constituting the water box and the expansion chamber, and it comprises a first duct 76 analogous to the first duct 30 of FIGS. 1 to 4 formed on the sheet 78 interconnecting the water box 68 and the expansion chamber 70, and a second duct 80, analogous to the second duct 32 of FIGS. 1 to 4, connecting the bottom of the first duct 76 to the expansion chamber 70. However, unlike the first embodiment, the top end of the first duct 76 is connected to the top end of the water box 78 by a small duct 82 which is an integral part of the moulding, and which is tangential, for example, to the top wall of the water box.

The heat exchanger shown in FIG. 5 has the cooling liquid flowing through it in one direction, i.e. via the inlet tube 66 to the water box 64 then through the tubes in the bundle 10 to the water box 68 and finally leaving via the tube 72. Bubbles of air or gas conveyed by the liquid tend to collect in the top of the water box 68 whence they are removed into the expansion chamber via the ducts 82, 76 and 80.

Figure 6:
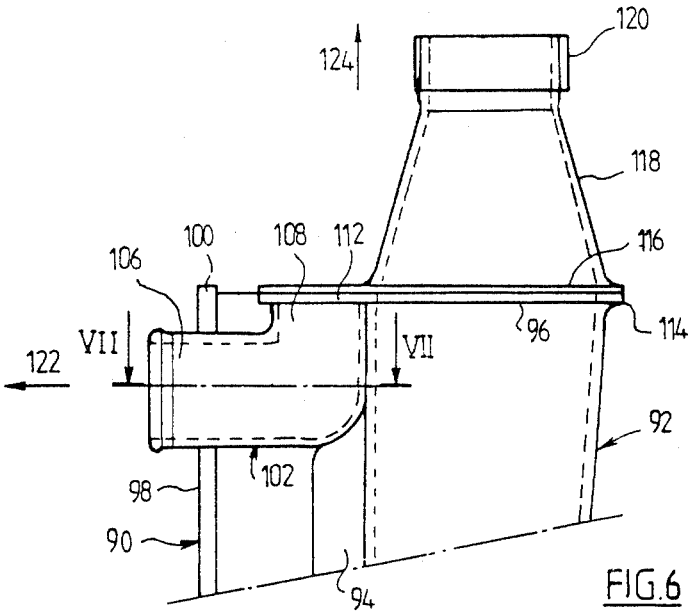
FIG. 6 is a partial plan view showing another variant.
Figure 7:
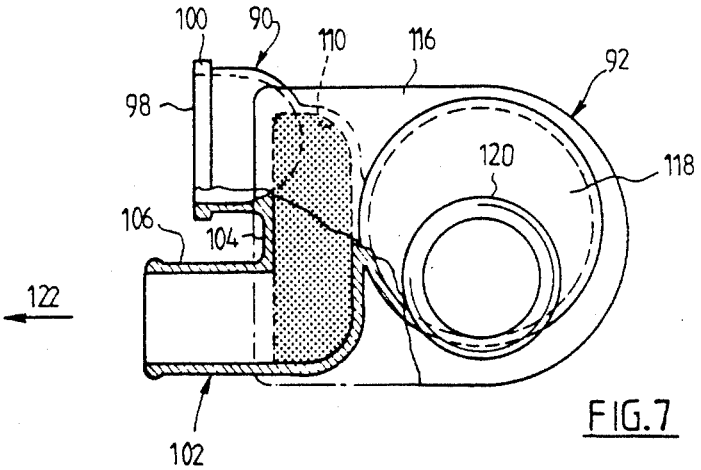
FIG. 7 is a partial section view on a line VII—VII in FIG. 6.

Reference is now made to FIGS. 6 and 7 which show a further variant of the water box and expansion chamber device in accordance with the invention, in which the water box 90 and the expansion chamber 92 are moulded from a single piece of plastic, with the water box 90 and the expansion chamber 92 being side by side and interconnected by a thin sheet 94 of the same plastic moulding.

The expansion chamber 92 is in the form of a slightly tapering cylindrical tube and its open top end 96 serves as an orifice for extracting a moulding core for defining the inside surface of the expansion chamber.

The water box 90 is generally elongate in shape and parallel to the longitudinal axis of the expansion chamber 92. Its cross-section is substantially semi-circular giving an open face 98 surrounded by a peripheral rim 100 by which it is fixed to a perforated plate at one end of a bundle of tubes in a heat exchanger in conventional manner.

The water box 90 is provided with a tube 102 which is integrally moulded therewith and which serves for connection to a liquid circuit, e.g. the cooling liquid circuit of an internal combustion engine in a motor vehicle.

In the example shown, this tube is generally L-shaped (FIG. 7) and comprises a first branch 104 connected to the water box 90 and a second branch 106 which extends perpendicularly to the first branch 104 and, for example, perpendicularly to the plane of the open face 98 of the water box 90.

The tube 102 is located at the top of the water box, close to the open upper end 96 of the expansion chamber 92.

In the example shown, the second branch 106 of the tube 102 is cylindrical and of circular section, while the first branch 104 has a quadrilateral cross-section, e.g. a rectangle or a square, and extends upwardly to the level of the open upper end 96 of the expansion chamber 92 in the form of a duct 108 which extends parallel to the longitudinal direction of the water box 90 and the expansion chamber 92. In the plane of the open top face 96 of the expansion chamber 92, this duct 108 has an orifice 110 which may, for example, have the shape shown in the shaded portion of FIG. 7 and which serves for removal of a moulding core.

The orifice 110 is surrounded by a peripheral rim 112 which extends in the same plan as the peripheral rim 114 surrounding the open upper end 96 of the expansion chamber 92.

Thus, the upper orifice 110 of the tube 102 and the upper end 96 of the expansion chamber 92 may be closed by a single cover 116 which is applied thereto and welded in place in a sealed manner around the rims 112 and 114.

The cover 116 may be in the form of a plane plate, or as shown in the figures, it may include an upwardly extending tapering portion 118 terminated by a cylindrical portion 120 suitable for receiving a conventional stopper (not shown) fitted with safety valves for releasing too much or too little pressure inside the expansion chamber.

The water box and expansion chamber device described above is unmoulded as follows: the portion of the mould corresponding to the inside surface of the water box 90 is unmoulded by translation in the direction indicated by an arrow 122, as is a core defining the inside surface of the second branch 106 of the tube 102. The moulding core defining the inside surface of the expansion chamber 92 is extracted by translation in the direction of an arrow 124 as is a moulding core for defining the inside surface of the first branch 104 of the tube 102, which core is extracted via the upper orifice 110 of the duct 108. The cross-section of this moulding core is substantially as shown by shading in FIG. 7.

After unmoulding, a single cover 116 applied to the rims 112 and 114 of the orifice 110 and the open upper end 96 of the expansion chamber 92 is welded thereto, e.g. by ultrasonic welding, thereby closing these upper openings in a sealed manner.

I claim:

1. A device comprising a water box and an expansion chamber for a heat exchanger, in particular for the radiator of the cooling circuit of an internal combustion engine, wherein the expansion chamber has an open end to which a cover is fixed and wherein the device includes a first duct in communication with the water box and having, in its portion adjacent to the open end of the expansion chamber, an orifice which is closed in a sealed manner by the cover of the expansion chamber, and a second duct angularly connected to said first duct and establishing communication between said water box and another part of said heat exchanger.

2. A device according to claim 1, wherein the two ducts are perpendicular.

3. A device according to claim 1, wherein the water box, the expansion chamber, and the ducts are moulded as a single piece.

4. A device according to claim 1, wherein the first duct is parallel to the axis of the expansion chamber and has its lower end opening out into the second duct integrally moulded with the water box and with the expansion chamber, and in communication via a first one of its ends with the expansion chamber, whereby the two ducts constitute a degassing passage for the liquid.

5. A device according to claim 4, wherein the other end of the second duct opens out into the water box and is suitable for being closed in a sealed manner by said water box being assembled to the body of a heat exchanger.

6. A device according to claim 4, wherein the second duct is substantially perpendicular to the first-mentioned duct and parallel to the direction in which the water box is unmoulded.

7. A device according to claim 4, wherein the first-mentioned duct is outside the water box and the expansion chamber, and passes through an inlet tube for admitting liquid into the upper portion of the water box, said inlet tube being integrally moulded with the water box, and the said first duct being in communication with said inlet tube via an opening through the wall of the duct, said wall of the duct being located inside the said inlet tube.

8. A device according to claim 7, wherein the said wall of the first duct extends inside the tube in the opposite direction to the direction of liquid flow.

9. A device according to claim 4, wherein the first-mentioned duct is outside the water box and outside the expansion chamber, the water box being moulded with a passage opening out into said duct.

10. A device according to claim 4, wherein the end of the second duct which is situated inside the water box is formed by a wall of the water box and by a partition depending from said wall and extending substantially up to the plane of the open face of the water box.

11. A device according to claim 1, wherein the duct having the above-mentioned orifice constitutes a portion of a tube for connecting the water box to a liquid circuit, said tube being integrally moulded with the water box.

12. A device according to claim 11, wherein the tube is L-shaped and includes a first branch connected to the water box and into which the conduit opens out, and a second branch which is, for example, perpendicular to the first branch or to the plane of the open face of the water box.

13. A device according to claim 12, wherein the said orifice also opens out into the water box and is substantially rectangular in shape.

* * * * *